United States Patent [19]

Konrad

[11] 4,192,043

[45] Mar. 11, 1980

[54] IMPROVED CLOSURE SEAL AND APPARATUS FOR APPLYING THE SAME

[76] Inventor: Albert Konrad, Rigistrasse 516, CH-5634 Merenschwand, Switzerland

[21] Appl. No.: 3,804

[22] Filed: Jan. 16, 1979

Related U.S. Application Data

[60] Continuation of Ser. No. 833,206, Sep. 14, 1977, which is a division of Ser. No. 676,497, Apr. 13, 1976, Pat. No. 4,056,128.

[30] Foreign Application Priority Data

Apr. 30, 1975 [CH] Switzerland ..... 5556/75

[51] Int. Cl.[2] ..... B65D 63/06

[52] U.S. Cl. ..... 24/21; 24/23 R; 24/23 W

[58] Field of Search ..... 24/21, 23 R, 23 W, 20 R, 24/20 EE, 20 CW, 22; 285/252, 254, 365, 402; 206/338

[56] References Cited

U.S. PATENT DOCUMENTS

| | | | |
|---|---|---|---|
| Re. 14,762 | 11/1919 | Springer | 24/20 CW |
| 912,788 | 2/1909 | Benson | 24/23 W |
| 1,783,192 | 12/1930 | Leslie | 24/23 W |
| 1,783,247 | 12/1930 | Leslie | 24/23 W |
| 1,981,371 | 11/1934 | Prindle | 24/23 W |
| 2,118,158 | 5/1938 | Carlson | 24/23 W |
| 3,224,055 | 12/1965 | Orser | 24/23 W |
| 3,736,627 | 6/1973 | Sosinski | 24/23 W |

FOREIGN PATENT DOCUMENTS

| | | | |
|---|---|---|---|
| 718627 | 9/1965 | Canada | 24/23 W |
| 942751 | 11/1963 | United Kingdom | 24/23 W |

*Primary Examiner*—Victor N. Sakran
*Attorney, Agent, or Firm*—O'Brien & Marks

[57] ABSTRACT

A closure seal for use in securing overlapped bands wrapping a package as disclosed in which the closure seal has a floor portion, a flange extending from one side thereof and a flap having two flap portions extending from the other side thereof. Apparatus for use with the closure seal is also disclosed.

3 Claims, 4 Drawing Figures

CLOSURE SEAL AND APPARATUS FOR APPLYING THE SAME

CROSS REFERENCE TO RELATED APPLICATION

This application is a continuation of U.S. application Ser. No. 833,206 filed Sept. 14, 1977 which is a divisional application of application Ser. No. 676,497 filed Apr. 13, 1976, now U.S. Pat. No. 4,056,128 issued Nov. 1, 1977.

BACKGROUND OF THE INVENTION

The present invention relates to a new and improved construction of apparatus for a closure seal for use in producing a connection between two overlapping band or tape sections of a strip or strap wrapped around a package, carton or the like, hereinafter sometimes referred to as packaging strip.

A device of the aforementioned general type is already known to the art wherein the closure mechanism incorporates tongs which close the closure seal around two overlapping band ends.

The closure seal required for this purpose exhibits an elongate floor portion, at the lengthwise extending sides of which there join a respective flap. This closure seal, when not yet deformed, possesses approximately the shape of an open U. During the closing operation the flaps and the legs of the U-shaped closure seal must be bent about the lengthwise extending sides of the floor portion and specifically to such an extent until the overlapping band sections are clamped between these flaps and the floor portion. To this end the prior art apparatus is placed upon the package and its actuation lever is rocked up and down until the closure seal has been closed. The actual closure operation is effective only during the downward movement of the actuation lever, i.e. when a pressure is exerted upon the actuation lever and therefore upon the package or the like. The force needed for the deformation of the aforementioned closure seal is relatively great, and accordingly, also the pressure which is transmitted to the package. In certain instances this can lead to damage to the package and its contents. Additionally, it is tiring to work with such apparatus since, as already stated, there must be applied a great deal of force for actuating the same.

SUMMARY OF THE INVENTION

Hence, it was therefore necessary to find a basically new technique for connecting the bands or tapes or the like which are strapped around a package or otherwise. Of course, it was also necessary to accordingly modify the internal construction of the mechanical components of the apparatus.

With the foregoing in mind it is a primary object of the present invention to provide an improved construction of strapping apparatus which is not associated with the aforementioned drawbacks and limitations of the prior art construction.

Another and more specific object of the present invention aims at the provision of a new and improved construction of a closure seal for use in establishing a connection between two overlapping band or tape sections of a strip wrapped around a package in a relatively easy and reliable manner, without any danger of damaging the package during the strapping operation.

Thus it is an object of the present invention is concerned with a novel construction of closure seal for a strapping machine.

Now in order to implement these and still further objects of the invention, which will become more readily apparent as the description proceeds, the closure seal used with the apparatus includes a floor portion, at one side of which there is attached a flange and at the other oppositely situated side a flap.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2, 3, 4:
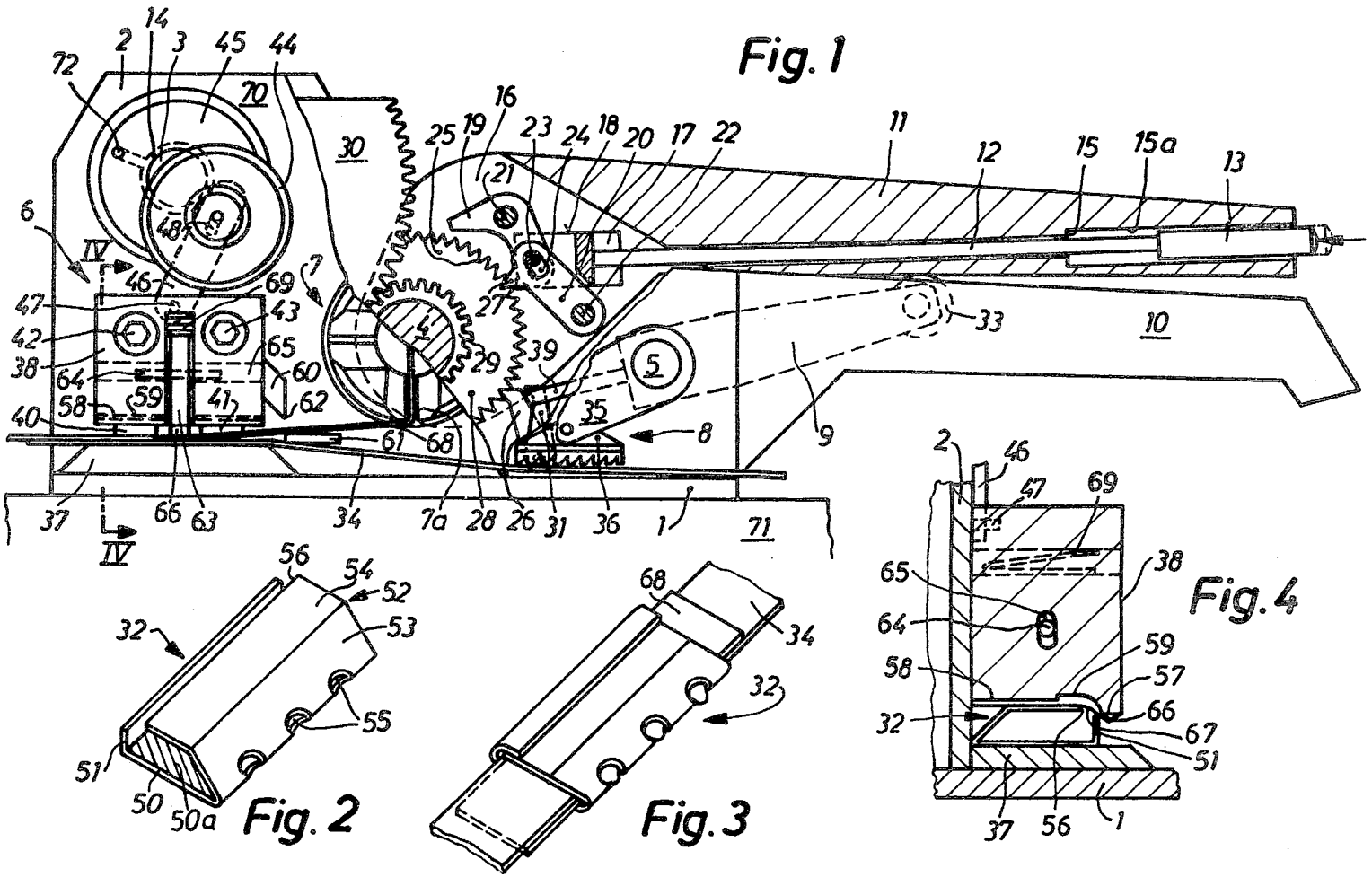
FIG. 1 is a side view, partially in section, of an exemplary embodiment of apparatus for use with a closure seal constructed according to the invention.
FIG. 2 illustrates the closure seal constructed according to the present invention used in the apparatus of FIG. 1, which seal is portrayed prior to deformation thereof.
FIG. 3 illustrates the closure seal of FIG. 2 in its deformed condition.
FIG. 4 is a cross-sectional view of the apparatus of FIG. 1, taken substantially along the lines IV—IV thereof.

Describing now the drawings, the hereinafter described exemplary embodiment of apparatus for use with the closure seal according to the present invention will be seen to comprise a base plate 1 to which there is secured in any suitable manner a housing 2. In the housing 2 there are rotatably mounted a total of three shafts 3, 4 and 5. By means of the first shaft 3 there is actuated a closure mechanism 6. The front end of the second shaft 4 carries a conventional tensioning roll or roller 7 for the for instance plastic band forming the packaging strapping or strip. This second shaft 4 further carries the actual actuation mechanism of the apparatus. The front end of the third shaft 5 carries an advance safety mechanism 8 for the strapping band, and the function of which will be discussed more fully hereinafter. A double-arm release lever 9 is arranged within the housing 2 and pivotably mounted upon the third shaft 5. The outer end of the release lever 9 can be downwardly rocked into a handle 10 connected with the apparatus housing 2.

The actuation mechanism of the apparatus contains an actuation lever 11 which is pivotable about the second shaft 4. This actuation lever 11 contains a pressure rod 12 which is mounted therein so as to be lengthwise displaceable. The outer end of the pressure rod 12 is provided with a push button 13 or equivalent structure, and a not particularly illustrated conventional pressure or compression spring bears at one end at the push button 13 and at the other end at the inner wall 15 of the recess **15*a* formed in the actuation lever 11 for receiving the push button 13**.

The end of the actuation lever 11 which is located within the housing 2 possesses a bifurcated configuration and the legs 16 of such bifurcated or fork-shaped end of the actuation lever 11 are mounted upon the second shaft 4. In FIG. 1 there is only visible the leg 16 of the actuation lever 11 which is located behind the sectional plane.

At least one of these legs 16 is equipped with a window 17 in which there is displaceably mounted a fork element 18. This fork element 18 is connected with the inner end of the pressure or push rod 12 and is intended for actuation of two pawls 19 and 20. These pawls 19 and 20 are pivotally mounted about the pins or plugs 21 and 22, which in turn are secured in the leg 16 of the bifurcated end of the actuation lever 11. Between the legs of the fork element 18 there extends a bolt 23 which passes through a respective elongate hole or slot 24 in the pawls 19 and 20.

The first pawl 19 is similar to a knee lever, the one end of which is provided with the aforementioned elongate hole or slot 24 and thus is connected with the pressure or push rod 12 and the push button 13. The other end of this pawl 19 can be brought into engagement with a first ratchet wheel 25 which is fixedly seated upon the second shaft 4, so that this ratchet wheel 25 is rigidly connected through the agency of the second shaft 4 with the band tensioning roll 7. A blocking pawl 26 also is in meshing engagement with this ratchet wheel 25, the blocking pawl 26 being urged by a not particularly illustrated leaf spring or equivalent structure against the ratchet wheel 25, so that it prevents a return rotation of the ratchet wheel 25 and therefore also the band tensioning roll 7.

The second pawl 20 has an elongate configuration and it carries a nose 27 arranged laterally of an elongate hole or slot 24 formed therein, this nose 27 can be brought into engagement with a second ratchet wheel 28. This second ratchet wheel 28 is rotatably mounted upon the second shaft and rigidly connected with a spur gear 29. Meshing with this spur gear 29 is a toothed segment 30 which is rigidly connected with the first shaft 3 and provides for the drive of the closure mechanism 6 of the apparatus, as such will be explained more fully hereinafter. The second ratchet wheel 28 is exposed to the action of a shiftable pawl 31. At the end of the closure operation of a closure seal 32 the pawl 31 is brought out of engagement with the second ratchet wheel 28, so that opening of the closure mechanism 6 is now possible.

The shifting of the pawl 31 is brought about by the action of the end of the double-arm release lever 9 which is located internally of the housing 2. This end of the release lever 9 is equipped with a gripper element or gripper 39 which engages with the underside of the shiftable pawl 31 and can slide at such side when the release lever 9 is moved out of its rest position into its operable or effective position. The shiftable pawl 31 is pressed by means of a likewise non-illustrated leaf spring against the second ratchet wheel 28.

The opposite end of the double-arm release lever 9 carries the roll or roller 33 which can roll upon the actuation lever 11.

As already mentioned the front end of the third shaft 5 carries a mechanism 8 which safeguards against any advance or forward movement of the section 34 of the band or tape forming the strapping of a package or the like during the tensioning of the strapping band. This advance securing mechanism 8 comprises an arm 35 which is secured at one end to the front end of the third shaft 5 and at the other end carries a toothed claw 36. The toothed claw 36 is movable towards the base plate 1 of the device and away from such base plate, so that the first band end 34 can be fixedly clamped therebetween.

The closure mechanism 6 comprises a table 37 attached to the base plate 1 and a punch 38 located above the table 37 and movable relative thereto. This displaceable punch 38 can be guided by means of a dovetail guide in the housing 2. However, it can also be guided by means of grooves 40 and 41 formed in the housing wall and in which grooves there move the shafts of two screws 42 and 43, the shaft ends being provided with non-illustrated nut members located at the rear face of the front housing wall 70.

The upper side or face of the punch 38 is flat and upon this surface there can roll a roller or roll 44 which is eccentrically arranged at a control disk or cam 45. This control disk 45 is rigidly connected with the first shaft 3 which also carries the toothed segment 30.

A traction lever 46 engages at the upper portion of the punch 38, this traction lever 46 is connected by means of a pin 47 with this portion of the punch 38. The traction lever 46 possesses an elongate hole or slot 48 in which there is located the shaft or axle of the roll 44. A spiral spring 14 is wound about the first shaft 3 and engages in a hole or aperture 72 in the control disk 45. This spiral spring 14 acts upon the control disk 45 in the counter clockwise direction, so that it strives to displace the punch 38 by means of the control disk 45 and the traction lever 46 away from the table 37.

In the work gap which is formed between the table 37 and the work surface of the punch 38 there can be inserted the closure seal 32 constructed in accordance with the present invention, as such has been illustrated in FIG. 4.

The closure seal 32, as shown in FIGS. 2–4 includes a flat elongate floor or bottom portion 50. Along one of the longer sides of the floor portion 50 there is attached thereto a flange 51 extending substantially perpendicular to the floor portion 50, as best seen by referring to FIG. 2. At the opposite lengthwise extending side of the floor portion 50 of the closure seal 32 there is attached a flap 52. This flap 52 includes a first portion 53 which directly attached to the floor portion 50 and extends relative thereto upwardly at an inclination. Attached to the outboard side edge of the first portion 53 of the flap 52 is a second portion 54 which extends substantially parallel to the floor portion 50.

The surfaces of the closure seal 32 which are intended to come into contact with the band or tape sections which are to be interconnected are provided with diagonally extending grooving **50*a* or serrations or equivalent means, into which there can flow the material of the plastic band during the squeezing together of the closure seal 32** and in this way there is provided a better securement of the position of the band ends in the closure seal.

As best seen by referring to FIG. 4 the upper edge or surface of the flange 51 is located at a lower level than the second portion 54 of the flap 52. Since the first portion 53 of the flap 52 extends upwardly at an inclination the outboard side edge 56 of the second flap portion 54 terminates a substantial lateral distance offset relative to the flange 51. Both of these measures render possible the lateral introduction of the band or tape portions which are to be interconnected into the closure seal 32.

FIG. 3 illustrates the closure seal 32 after completion of a closure operation. The two band portions 34 and 68 which are to be interconnected are fixedly clamped between the floor or bottom portion 50 of the closure seal 32 and the flap 52 and placed over the front portion of the flap 52 is the flange 51. In this deformed state the flap 52 is likewise substantially flat.

Now in order to be able to attain such configuration of the closure seal 32 it is necessary to impart to the work or working surface of punch 38 a form suitable for such purpose. The working surface of the punch 38 will be seen to comprise a flat, however relatively narrow end surface 57 which is located closest to the surface of the table 37. Moreover, the working surface of the punch 38 possesses a likewise flat contact or press surface 58 which is offset rearwardly relative to the end surface 57 by an amount which is smaller than the height of the pressed together closure seal 32 at the region of the flap 52. The press or pressure-applying surface 58 serves to bring the flap 52 closer to the floor portion 50 of the closure seal 32 and to thus clamp therebetween the band or tape portions 34 and 68 which are to be connected with one another.

Between the end surface 57 and the press or contact surface 58 there is located a curved flanging surface 59 which is rearwardly offset relative to the press surface 58. During the closure operation of the closure seal 32 this surface 59 acts upon the initially upright flange 51 and deforms such in the manner that after completion of the closure operation the flange 51 is deflected or flexed about the outboard side edge 56 of the flap 52. The indicated curvature of the flanging surface 59 renders possible the required deformation of the flange 51.

Secured to the side surface of the punch 38 is a cutting knife or cutter 60 which is movable up and down conjointly with the punch 38. This cutting knife 60 is operatively associated with a support 61 for that portion 68 of the band of the package strip or strapping which is located between the punch 38 and the tensioning roll 7. During a downward movement of the punch 38 the cutting edge 62 moves past the support or support member 61 and thus severs the band portion 68 at the region of the support member 61.

In order to secure the position of the closure seal 32 in the work gap of the apparatus during the introduction of the band portions 34 and 63 to be interconnected, the punch 38 is equipped with a holddown device or element 63 for the closure seal 32. The holddown element 63 is here shown as a plate member which can be moved up and down in a recess of the punch 38. In the holddown plate 63 there is secured a transversely extending limiting pin 64 which can move within an elongate hole or slot 65, whereby the path of movement of the holddown element 63 is limited at the top and bottom.

In order to increase the pressure of the holddown element 63 upon the closure seal 32 there can be employed a hairpin spring 69 which is arranged above the holddown element 63 between such and the upper portion of the punch 38.

The lower side of the holddown plate or holddown element 63 possesses a nose 66. An inner inclined surface 67 of the holddown plate 63 insures that the closure seal 32 introduced into the work gap of the apparatus and not yet deformed will continually bear against the front side or face 70 of the apparatus housing. To insure for good closure of the closure seal it is necessary that the flange 51 bears against the curved portion of the flanging surface 59.

Having now had the benefit of the description of the exemplary embodiment of apparatus its mode of operation will be considered and is as follows:

Initially a closure seal 32 is introduced into the gap located between the punch 38 and the table 37. In FIG. 1 the closure seal has not been shown in order to reveal other details of the strapping apparatus. The closure seal 32 must be pushed to such an extent into the work gap that it bears against the front wall or side 70 of the apparatus housing 2, as best seen by referring to FIG. 4. Then a first band portion, for instance the band end 34, is introduced into the still open closure seal 32 either by being laterally inserted or in the direction of its length. The band is initially placed between the toothed claw 36 and the base plate 1 and then wrapped about the package or other container or the like until the other band end 68 again bears at the apparatus. Now also this band end 68 is introduced into the closure seal 32 in the already indicated manner, whereafter it is inserted at a location above the support member 61 into one of the slots 7*a* of the band tensioning roll 7. Now it is possible to move the actuation lever 11 to-and-fro. Initially the push button 13 is not actuated, so that the first pawl 19 is in engagement with the first ratchet wheel 25. During an upward movement of the actuation lever 11 the first ratchet wheel 25 is thus somewhat rotated in the counter clockwise direction. Since this ratchet wheel 25 is rigidly connected with the band tensioning roll 7 through the agency of the second shaft 4, the band tensioning roll 7 also rotates in the same sense, so that the second band end 68 is wound-up at the band tensioning roll 7. During the downward directed movement of the actuation lever 11 the spring-loaded first pawl 19 jumps over the teeth of the first ratchet wheel 25 because such is prevented from any rearward rotation by the blocking pawl 36. With progressive up and down movement of the actuation lever 11 an increasingly greater amount of the band is wound onto the tensioning roll 7, and the toothed claw 36 prevents a forward movement of the other band end 34 so that the band which is wrapped about the package is progressively tensioned. When the band has had sufficient tension applied thereto, i.e. is adequately tightened, then the push button 13 is depressed. Consequently, the first pawl is brought out of engagement with the first ratchet wheel 25, but this ratchet wheel 25 cannot rotate back due to the action of the blocking pawl 26, so that the band still remains tensioned. Now the second pawl 20 is however in engagement with the second ratchet wheel 28 and during the further up and down rocking of the actuation lever 11 the second ratchet wheel 28 is rotated in counter clockwise direction. This ratchet wheel 28 however is in engagement via the gear 29, the toothed segment 30 and the control disk 45 with the roll or roller 44. The roll 44 therefore progressively approaches the punch 38 until it begins to roll upon its upper face or surface, whereafter the punch 38 likewise carries out a downward movement. Hence, under the action of the punch 38 the flap 52 is urged in the direction of the floor or bottom portion 50 of the closure seal 32 and both of the band ends 34 and 68 are increasingly pressed together therebetween until finally these band ends are fixedly connected with one another by means of the thus deformed closure seal 32. In the last phase of the closing operation the cutting edge 62 of the cutting knife 60 moves past the support member 61, resulting in a separation of the portion of the band end 68 which is part of the package strapping from the remaining part of the band end 68 which has been wound about the tensioning roll 7.

During this last phase of the closure operation the flange 51 is also deformed by the flanging surface 59 and specifically in such a manner that it is flexed about the flaps 52. The band material has at least partially filled out the openings 55, so that there is further positively insured for the holding together of the overlapping band portions.

If the lever 11 is also then actuated when the punch 38 has reached its lowest possible point after carrying out a seal closure operation, then the resistance of the punch 38 is so great that the second ratchet wheel 28 no longer can further rotate and the second pawl 20 thus jumps, against the force exerted upon the push rod 12, over the teeth of the second ratchet wheel 28.

Now if lever 11 is no longer actuated then the punch 38 remains in its lowermost position because the shiftable pawl 31 of the second ratchet wheel 28 is prevented from carrying out a rotation in the clockwise direction.

Now in order to remove the interconnected band portions of a package strapping from the work gap of the apparatus, the actuation lever 11 is rocked to such an extent downwardly until the roll or roller 33 of the release lever 9 rolls upon the actuation lever 11. As a result, the toothed claw 36 is raised, so that the first band portion 34 is released. At the same time the gripper or gripper element 39 at the inner end of the release lever 9 slides at the forward or front surface of the shiftable pawl 31 and thus brings such out of engagement with the second ratchet wheel 28. Under the action of the spiral or helical spring 14 acting upon the control disk 45 the latter is rotated in counter clockwise direction, so that the roller or roll 44 can move at the same time upwards. At the shaft of this roller 44 there is however connected the punch 38 through the agency of the traction lever 46, so that the punch 38 likewise moves upwards but with a certain delay. Now the connection location of both band portions is free and the apparatus can be laterally withdrawn out of the strapping or strip placed about the package 71.

With the described apparatus the closure operation only is effective during the upward movement of the actuation lever 11, so that no pressure is exerted upon the package or the like during the closing operation, and consequently, neither the package nor its contents can be damaged. By virtue of the speed reduction brought about by the ratchet wheel 28, the gear 29 and the segment 30, and finally also owing to the shape of the seal 32, the force needed for closing the seal around the band ends is relatively small, and hence, the described apparatus can be operated with very little effort. Since only very small closure forces are applied at the lever 11, it is possible with the use of the apparatus of the invention to be able to close seals at hard to reach or otherwise extreme locations, for instance vertical or very high locations.

While there are shown and described present preferred embodiments of the invention, it is to be distinctly understood that the invention is not limited thereto, but may be otherwise variously embodied and practiced within the scope of the following claims.

What is claimed is:

1. A closure seal for use with strapping apparatus for interconnecting overlapping band sections of a plastic strap, the closure seal comprising a floor portion having a pair of oppositely situated lengthwise extending sides, a flange extending vertically upward from one lengthwise extending side of the floor portion, a flap extending from the oppositely situated lengthwise extending side of the floor portion, said flap including first and second portions, the first portion being a flap portion connected to the side of the floor portion and positioned at an inclination relative thereto, the second portion being a flap portion extending from the first portion substantially parallel to the floor portion, said flap being bendable against the band sections to secure the band sections, and said flange being adapted to being folded over for overlapping an adjacent part of said flap, and said flap and said floor portion having a plurality of openings, each opening extending in the connection between the flap and the floor portion and into both the floor portion and the first portion of the flap for receiving band material out of the openings to insure holding of overlapping band portions.

2. The closure seal as defined in claim l, wherein the flange edge has an upper edge portion located below the second portion of the flap.

3. The closure seal as defined in claim l, wherein the closure seal includes surfaces intended to come into contact with the band sections to be interconnected, said surfaces having diagonally extending grooves.

* * * * *